US005131191A

United States Patent [19]

Mayahara et al.

[11] Patent Number: 5,131,191

[45] Date of Patent: Jul. 21, 1992

[54] FLUID CIRCUIT FOR WORK HANDLING APPARATUS

[75] Inventors: Kiyoshi Mayahara; Mamoru Inoue, both of Hirakata; Keniti Matumura, Neyagawa, all of Japan

[73] Assignee: Matsushita Electric Industrial Co., Ltd., Osaka, Japan

[21] Appl. No.: 627,935

[22] Filed: Dec. 17, 1990

[30] Foreign Application Priority Data

Dec. 19, 1989 [JP] Japan ..... 1-330749

[51] Int. Cl.[5] ..... B24B 41/06

[52] U.S. Cl. ..... 51/165.9; 51/216 LP; 51/235

[58] Field of Search ..... 51/235, 217 L, 216 LP, 51/165.9, 263, 264, 424, 425; 269/21

[56] References Cited

U.S. PATENT DOCUMENTS 4,993,200 2/1991 Morioka et al. ..... 51/424

*Primary Examiner*—Bruce M. Kisliuk
*Assistant Examiner*—E. Morgan
*Attorney, Agent, or Firm*—Wenderoth, Lind & Ponack

[57] ABSTRACT

A fluid circuit for a work handling apparatus having a suction holder adapted to be selectively communicated with a vacuum source and a compressed air source, an having a first electromagnetic valve having first, second and third ports which are fluid-connected with the vacuum source, the compressed air source and the suction holder, respectively. The first electromagnetic valve is operable, when in a suction position, to communicate the first and third ports with each other and, when in a release position, to communicate said second and third ports with each other. The fluid circuit also has a first passage communicating the suction holder and the third port of the first electromagnetic valve with each other, a pressure sensor, a second electromagnetic valve operable to selectively establish and open a fluid circuit between the pressure sensor and the first passage. The fluid circuit is provided with a gas-liquid separating element disposed in the first passage for separating a liquid component, sucked into the suction holder and then into the first passage, from air. A parallel fluid circuit extends between the compressed air source and the second port of the first electromagnetic valve and including first and second flow regulators, and a switching valve is provided in the parallel fluid circuit for selectively connecting one or both of the first and second flow regulators into the parallel fluid circuit.

1 Claim, 2 Drawing Sheets

FLUID CIRCUIT FOR WORK HANDLING APPARATUS

BACKGROUND OF THE INVENTION 1. (Field of the Invention)

The present invention generally relates to the handling of work in a grinding machine and, more particularly, to a fluid circuit for a work handling apparatus used in the work grinding machine for automatically picking up and releasing a work such as, for example, an optical lens element, onto and from a suction holder.

2. (Description of the Prior Art)

An example of work handling apparatus hitherto employed in an existing lens grinding machine is schematically shown in FIG. 3 of the accompanying drawings, reference to which will now be made for the detailed discussion thereof.

The prior art work handling apparatus shown in FIG. 3 is of a type capable of handling a lens element to be polished and comprises a suction holder 2 for releasably holding the lens element 1. This apparatus also comprises a source of vacuum employed in the form of a vacuum pump 3 pneumatically connected with the suction holder 2 through a tubing by way of an electromagnetic valve 4. The electromagnetic valve 4 has two operative positions, i.e., suction and release positions, and is operable to communicate the suction holder 2 with the vacuum pump 3 when in the suction position and with a source of compressed air 5 when in the release position. A portion of the tubing between the suction holder 2 and the electromagnetic valve 4 is pneumatically connected with a pressure sensor 7 and a vacuum gauge 9. ON the other hand, the air supply tubing extending between the compressed air source 5 and the electromagnetic valve 4 has a flow controller 10 for regulting the flow of the compressed air from the compressed air source 5 towards the suction holder 2 through the electromagnetic valve 4.

The prior art work handling apparatus of the above described construction operates in the following manner. Depending on the position of the electromagnetic valve 4, the lens element 1 can be selectively picked up by suction and released from the suction holder 2. When the lens element 1 is picked up by the suction holder 2, the suction holder 2 is communicated with the vacuum pump 3 through the electromagnetic valve 4 then in the suction position, but when the lend element 1 is released from the suction holder 2, the latter is communicated with the compressed air source 5 through the electromagnetic valve 4 then in the release position. The pressure sensor 7 is used to detect whether the lens element 1 has been picked up by the suction holder 2 or whether the lens element 1 is released from the suction holder 2. When it is desired to polish the lens element 1, the electromagnetic valve 4 is switched over to the release position after the lens element 1 picked up by the suction holder 2 has been pressed against a processing tool (not shown), and a grinding or polishing process is carried out for a predetermined length of time while an abrasive fluid is simultaneously supplied to the processing tool and the lens element. After the grinding or polishing process, the electromagnetic valve 4 is switched over to the suction position to cause the suction holder 2 to pick up the lens element thereby removing it from the processing tool.

It has, however, been found that the prior art work handling aparatus has a problem in that, as the work handling apparatus is operated repeatedly through a number of cycles, the abrasive fluid tends to be sucked into the pneumatic tubing system and then into the vacuum pump, thereby causing damage to the vacuum pump. In addition, since the abrasive fluid once sucked into a portion of the pneumatic tubing when the electromagnetic valve has been in the suction position will enter the pressure sensor when the electromagnetic valve is switched over to the release position, the pressure sensor 4 may also be damaged. Those problems constitute a cause of reduction in reliability of the work handling apparatus.

SUMMARY OF THE INVENTION

The present invention has been made with a view to substantially eliminate the above discussed problems inherent in the prior art work handling apparatus used in operative association with a work grinding machine and is intended to provide an improved work handling apparatus having a high reliability and a minimized possibility of troubles and malfunctions.

In order to accomplish the above described and other objects of the present invention, there is provided a fluid circuit for a work handling apparatus having a suction holder adapted to be selectively communicated with a source of vacuum and a source of compressed air. The fluid circuit comprises a first electromagnetic valve assembly having suction and release positions and also having first, second and third ports, which are fluid-connected with the vacuum source, the compressed air source and the suction holder, respectively. The first electromagnetic valve assembly is operable, when in the suction position, to communicate the first and third ports with each other and, when in the release position, to communicate said second and third ports with each other. The fluid circuit also comprises a first passage means communicating the suction holder and the third port of the first electromagnetic valve assembly with each other, a pressure sensor, a second electromagnetic valve assembly operable to selectively establish and open a fluid circuit between the pressure sensor and the first passage means.

In accordance with the present invention, the fluid circuit for the work handling apparatus is provided with a gas-liquid separating element disposed in the first passage means for separating a liquid component, sucked into the suction holder and then into the first passage means, from air; parallel fluid passages extending between the compressed air source and the second port of the first electromagnetic valve assembly and including first and second flow regulators; and a switching valve means provided in the parallel fluid passages for selectively bringing one or both of the first and second flow regulators into communication with the second port of the first valve assembly.

According to the present invention, only when it is necessary to determine if the work has been properly picked up by the suction holder is the second electromagnetic valve assembly activated to establish the fluid circuit between the pressure sensor and the first passage means thereby to avoid an undesirable ingress of the abrasive fluid into the first passage means. However, since there is a time lag between the time at which the first electromagnetic valve assembly is brought into the suction position and the time at which the second electromagnetic valve assembly is activated to establish such fluid circuit, the filter is used to separate the abrasive fluid from air entering into the first passage means through the suction holder during this time lag.

Thus, it is clear that, according to the present invention, any possible damage to and/or malfunctioning of the work handling apparatus which would result from the ingress of the abrasive fluid can be advantageously avoided.

BRIEF DESCRIPTION OF THE DRAWINGS

These and other objects and features of the present invention will become clear from the following description of a preferred embodiment thereof with reference to the accompanying drawings, in which.

DETAILED DESCRIPTION OF THE EMBODIMENT

Figure 1:
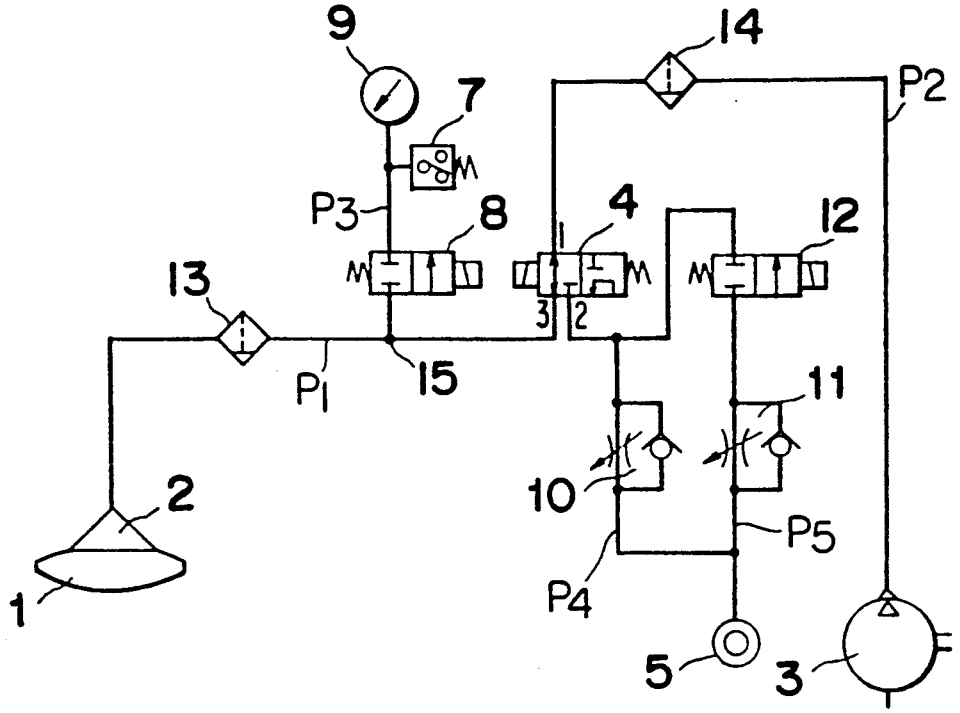
FIG. 1 is a schematic diagram showing a pneumatic circuit used in a work handling apparatus embodying the present invention.
Figure 3:
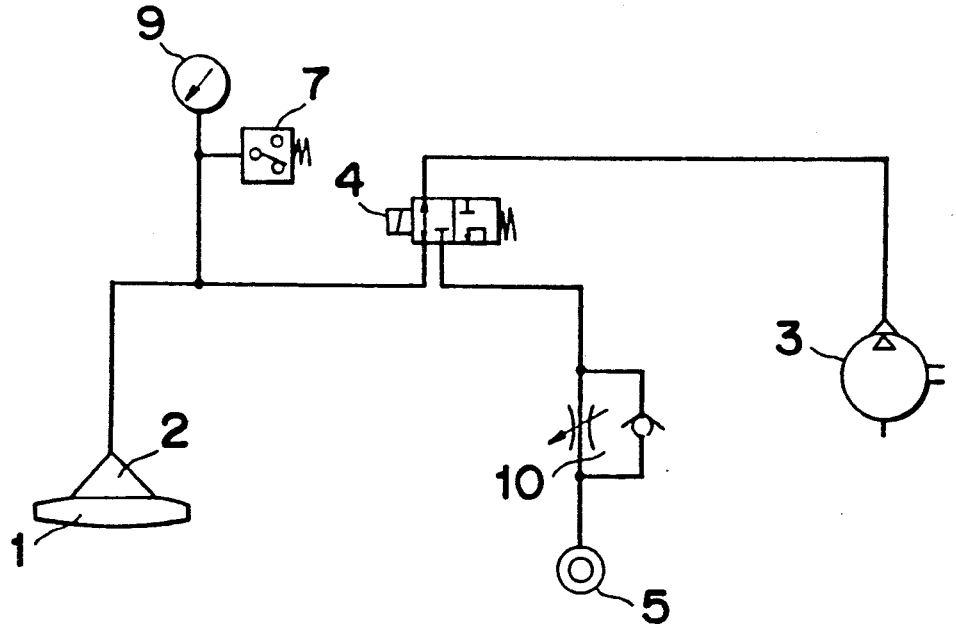
Fig. 3 Prior Art
FIG. 3 is a schematic diagram showing the pneumatic circuit used in a prior art work handling apparatus.

Before the description of the present invention proceeds, it is to be noted that like parts are designated by like reference numerals throughout the accompanying drawings.

Referring first to FIG. 1, the illustrated pneumatic circuit for the work handling apparatus according to the present invention comprises an electromagnetic valve 4 having suction and release positions. This electromagnetic valve 4 is operable, when in the suction position as shown, to communicate the suction holder 2 with the vacuum pump 3 through a pneumatic passage P1 and then through a pneumatic passage P2, but when in the release position, to communicate the suction holder 2 with the compressed air source 5 through the pneumatic passage P1 and then through a system as will be described later. The pressure sensor 7 and the vacuum gauge 9 are fluid connected with the pneumatic passage P1 through a sensing passage P3 having an electromagnetic valve 8 disposed therein. The electromagnetic valve 8 has two operative positions, i.e., open and closed positions, and establishes a communication between both the pressure sensor 7 and the vacuum gauge 9 and the pneumatic passage P1 when and so long as it is in the open position.

The system between the pneumatic valve 4 and the compressed air source 5 includes two pneumatic passages P4 and P5. The pneumatic passage P4 has a flow regulator 10 disposed therein for the control of the flow of the compressed air therethrough while the pneumatic passage P5 parallel to the pneumatic passage P4 has a flow regulator 11 for the control of the flow of the compressed air therethrough and an electromagnetic valve 12 both disposed therein, said electromagnetic valve 12 having two operative positions, i.e., open and closed positions.

A portion of each of the pneumatic passage P1 between the suction holder 2 and either of the electromagnetic valves 4 and 5 and the pneumatic passage P2 have air filters 13 and 14 disposed therein, respectively, each of said air filters being operable to lower the velocity of flow of air thereby to separate the abrasive fluid from the air.

The work handling apparatus utilizing the pneumatic circuit of the above described construction operates in the following manner.

Figure 2:
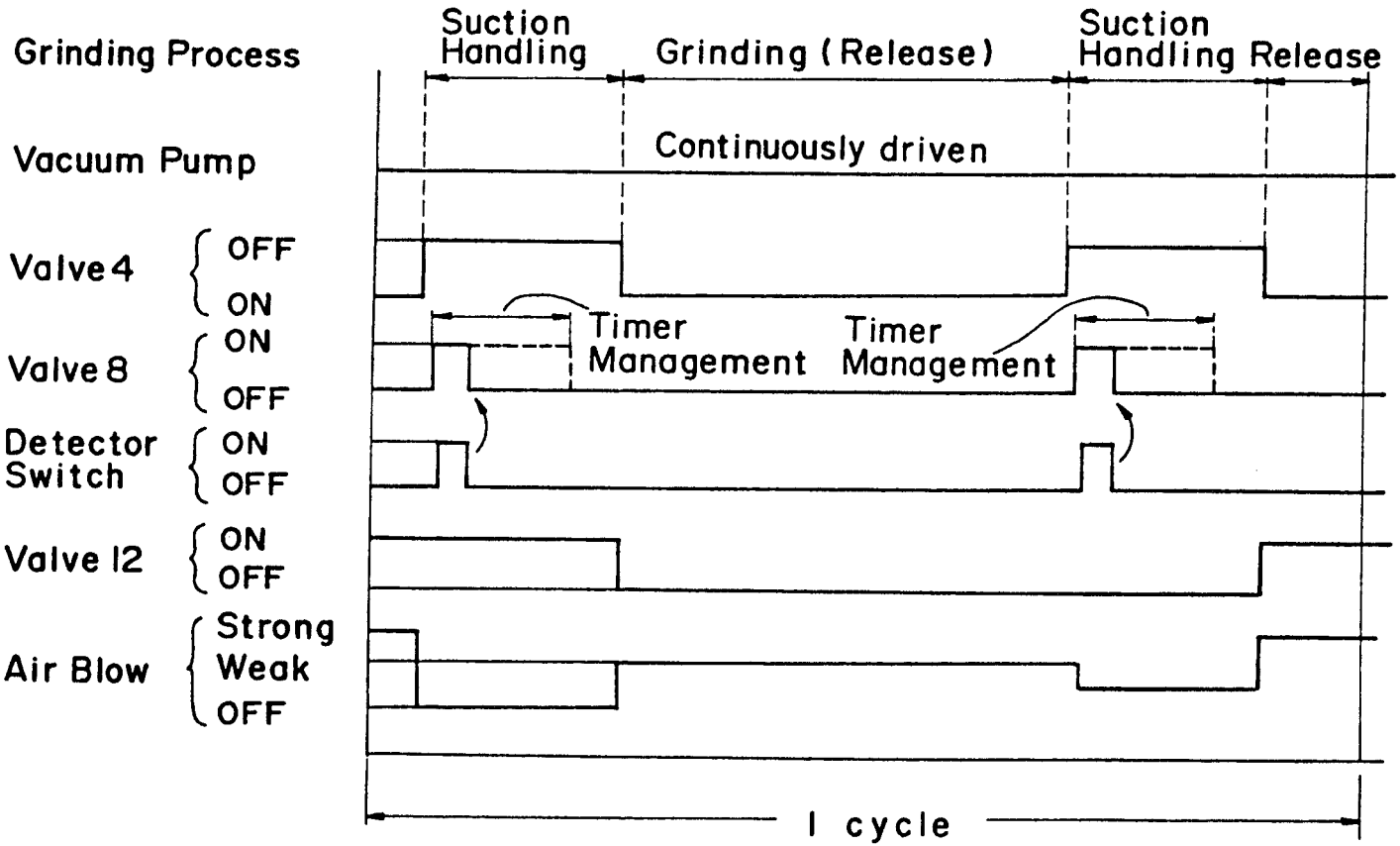
FIG. 2 is a timing chart showing the sequence of operation of the pneumatic circuit shown in FIG. 1.

Referring now to FIG. 2 showing the timing chart illustrating the sequence of operation of the work handling apparatus, a cycle of a grinding process includes a first suction handling step, a grinding step, a second suction handling step and a release step. During the first suction handling step, the work 1 is picked up by the suction holder 2 and is then processed to the processing tool; during the grinding of the work 1 step, the grinding is effected while the abrasive fluid is supplied to the work 1; during the second suction handling step, the work 1 which has been ground is picked up by the suction holder 2 and is separated from the processing tool; and during the release step, the work is released from the suction holder 2.

Assuming that the vacuum pump 3 is continuously driven as a result of the supply of electric power thereto, and during the first suction handling step, the electromagnetic valve 4 is switched off to cause the valve to assume the suction position as shown with the suction holder 2 consequently communicated with the vacuum pump 3 through the passages P1 and P2, and the work 1 which has not yet been processed is picked up by the suction holder 2. When the electromagnetic valve 8 is subsequently switched on to the open position it activates both the pressure sensor 7 and the vacuum gauge 9. Should at this time the suction holder 2 hold the work 1 properly, the pressure sensor 7 detects a negative pressure and is therefore switched on to issue a close signal therefrom. This close signal from the pressure sensor 7 is applied to the electromagnetic valve 8 to interrupt the supply of electric power thereto, causing the electromagnetic valve 8 to assume the closed position as shown. The electromagnetic valve 8 is controlled by a timer such that, unless the pressure sensor 7 fails to be switched on after a predetermined length of time subsequent to the pick-up of the work 1 onto the suction holder 2, no subsequent grinding step can take place.

After the first suction handling step, the electromagnetic valve 4 is switched on to the release position in which the passage P1 is communicated with the compressed air source 5. At the time the electromagnetic valve 12 in the pneumatic passage P5 is subsequently switched off to assume the closed position simultaneously with the switching-on of the electromagnetic valve 4, the compressed air from the compressed air source 5 flows only through the pneumatic passage P4 via the flow regulator 10 and is then supplied to the suction holder 2 to release the work 1 therefrom in readiness for the next succeeding handling step.

The flow regulator 10 is so adjusted as to allow the flow of compressed air therethrough at a rate considerably throttled as compared with the flow regulator 11 so that the air flow, at this time, is weak, as shown by the bottom line of FIG. 2. After the termination of the grinding step, the electromagnetic valve 4 is switched off to cut off the weak air flow and to assume the suction position to communicate the suction holder 2 with the vacuum pump 3 therethrough and, simultaneously therewith, the electromagnetic valve 8 is switched on to communicate both of the pressure sensor 7 and the vacuum gauge 9 with the pneumatic passage P1. In this condition, the work 1 which has been processed is picked up by the suction holder 2 to separate it from the processing tool. Substantially at the time of establishment of a vacuum in the passages P1 and P3, more specifically, substantially simultaneously with the timing at which the electromagnetic valve 8 is switched on, the pressure sensor 7 detects the presence of the negative pressure and is, therefore, switched on to issue the close signal which is applied to the electromagnetic valve 8 to cause the latter to assume the closed position as shown.

Although a quantity of the abrasive fluid may be sucked through the suction nozzle 2 into the pneumatic passage P1 and then into the pneumatic passage P3 at an initial stage of the first suction handling step, that is, during a length of time subsequent to the time at which the electromagnetic valve 8 is switched on in response to the switching-off of the electromagnetic valve 4 and prior to the time at which the electromagnetic valve 8 is switched off in response to the close signal supplied from the pressure sensor 7, the abrasive fluid entering the pneumatic passage P1 can be separated from air by the filter 13 and, therefore, does not flow further into the pneumatic passages P1 and P3.

After the work 1 being processed has been picked up by the suction holder 2 at the end of the second suction handling step, and in readiness for the removal of the processed work 1 from the suction holder 2, the electromagnetic valve 4 is switched on and, simultaneously therewith, the electromagnetic valve 12 is switched on to communicate the suction holder 2 with the compressed air source 5 by way of the pneumatic passage P1 and both of the parallel pneumatic passages P4 and P5. As a result, a strong flow of compressed air is supplied to the suction holder 2 to eject the processed work 1.

Although the present invention has been described in connection with the preferred embodiment thereof with reference to the accompanying drawings, it is to be noted that various changes and modifications will be apparent to those skilled in the art. For example, although reference has been made to the use of the vacuum pump as a source of vacuum, any other suitable source of vacuum may be employed.

Also, although the use of the filters 13 and 14 for separating the abrasive fluid from air by the utilization of a difference in flow velocity has been described, they can be replaced with respective closed vessels of a volume greater than the volume of the associated passages.

Accordingly, such changes and modifications are to be understood as included within the scope of the present invention as defined by the appended claims, unless they depart therefrom.

What is claimed is:

1. In a work handling apparatus having a suction holder and a source of vacuum and a source of compressed air, a fluid circuit for selectively connecting the suction holder to the source of vacuum and the source of compressed air, said fluid circuit comprising:

a first electromagnetic valve assembly having suction and release positions and also having first, second and third ports, and being operable, when in the suction position, to communicate the first and third ports with each other and, when in the release position, to communicate said second and third ports with each other;

a first passage means communicating the suction holder and said third port of said first electromagnetic valve assembly;

a second passage means communicating said first port with the vacuum source;

a pressure sensor;

a third passage means communicating said first passage means with said pressure sensor;

a second electromagnetic valve assembly in said third passage means operable to selectively establish and open fluid communication between said pressure sensor and said first passage means;

a gas-liquid separating element disposed in said first passage means between the suction holder and said third passage means for separating a liquid component, sucked into the suction holder and then into the first passage means, from air;

a pair of pressure fluid passages connected in parallel between the compressed air source and said second port of said first electromagnetic valve assembly and respectively having first and second flow regulators therein, the first flow regulator permitting higher pressure flow than the second pressure regulator; and a switching valve means in the pressure flow passage with said first flow regulator therein for selectively permitting higher pressure flow to said second port of said first electromagnetic valve assembly when said switching valve means is open and permitting only lower pressure flow to said second port of said first electromagnetic valve assembly when said switching valve means is closed.

* * * * *